US007921588B2

(12) United States Patent
Brown et al.

(10) Patent No.: US 7,921,588 B2
(45) Date of Patent: Apr. 12, 2011

(54) SAFEGUARD SYSTEM FOR ENSURING DEVICE OPERATION IN CONFORMANCE WITH GOVERNING LAWS

(75) Inventors: Kenneth W. Brown, Yucaipa, CA (US); James R. Gallivan, Pomona, CA (US)

(73) Assignee: Raytheon Company, Waltham, MA (US)

( * ) Notice: Subject to any disclaimer, the term of this patent is extended or adjusted under 35 U.S.C. 154(b) by 1075 days.

(21) Appl. No.: 11/678,490

(22) Filed: Feb. 23, 2007

(65) Prior Publication Data

US 2010/0269674 A1 Oct. 28, 2010

(51) Int. Cl.
*F41A 17/00* (2006.01)

(52) U.S. Cl. ..... 42/70.01; 42/114; 42/70.11; 89/1.11; 89/41.01; 89/41.03; 89/41.05; 89/41.06; 89/41.07

(58) Field of Classification Search ..... 42/70.01, 42/144, 70.11; 89/1.11, 41.01, 41.03, 41.05, 89/41.06, 41.07, 40.03
See application file for complete search history.

(56) References Cited

U.S. PATENT DOCUMENTS

| | | | | |
|---|---|---|---|---|
| 5,822,713 | A | 10/1998 | Profeta | |
| 5,837,918 | A * | 11/1998 | Sepp | 89/1.11 |
| 5,953,844 | A * | 9/1999 | Harling et al. | 42/70.06 |
| 5,966,859 | A * | 10/1999 | Samuels | 42/70.11 |
| 5,992,288 | A | 11/1999 | Barnes | |
| 6,357,156 | B1 * | 3/2002 | Klebes et al. | 42/70.11 |
| 6,363,647 | B2 * | 4/2002 | Kaminski | 42/70.11 |
| 6,421,943 | B1 * | 7/2002 | Caulfield et al. | 42/70.11 |
| 6,434,875 | B1 * | 8/2002 | Constant et al. | 42/84 |
| 6,871,439 | B1 * | 3/2005 | Edwards | 42/84 |
| 7,019,640 | B2 | 3/2006 | Canich | |
| 7,049,998 | B1 | 5/2006 | Frady et al. | |
| 7,126,477 | B2 | 10/2006 | Gallivan | |
| 7,210,392 | B2 * | 5/2007 | Greene et al. | 89/41.03 |
| 7,389,604 | B2 * | 6/2008 | Newkirk et al. | 42/70.11 |
| 7,784,390 | B1 * | 8/2010 | Lowell et al. | 89/1.11 |
| 2002/0112390 | A1 * | 8/2002 | Harling et al. | 42/70.11 |
| 2003/0136043 | A1 * | 7/2003 | Lauster et al. | 42/70.11 |
| 2004/0031180 | A1 * | 2/2004 | Ivanov | 42/70.11 |
| 2005/0066567 | A1 * | 3/2005 | Newkirk et al. | 42/70.11 |
| 2005/0156743 | A1 * | 7/2005 | Gallivan et al. | |
| 2006/0047543 | A1 | 3/2006 | Moses | |
| 2006/0234191 | A1 * | 10/2006 | Ludman | |
| 2006/0256559 | A1 * | 11/2006 | Bitar | |
| 2006/0283317 | A1 | 12/2006 | Meinychuk et al. | |

(Continued)

FOREIGN PATENT DOCUMENTS

WO 2007022339 A2 * 2/2007

*Primary Examiner* — Troy Chambers
*Assistant Examiner* — Samir Abdosh
(74) *Attorney, Agent, or Firm* — Eric A. Gifford

(57) ABSTRACT

A safeguard system ensures device operation in conformance with governing laws for devices such as directed energy weapons or surveillance systems, whose misuse may discomfort, harm or otherwise violate the legal rights of a person. A legal protocol is defined by rules embodying the laws that govern the use of the device and requires as inputs an authorization to use the device and input condition(s) relating to at least one of a use of the device, an attribute of a human target of the device and an operational environment of the device and human target. The safeguard system applies the rules to the authorization and input condition(s) to generate a control signal that ensures the device is used in conformance with the legal protocol. A documentation system records the authorization, input condition(s) applied rules, and control signal.

24 Claims, 12 Drawing Sheets

U.S. PATENT DOCUMENTS

2007/0008514 A1 1/2007 Krasutsky
2007/0119088 A1* 5/2007 Newkirk et al. ..... 42/70.11
2007/0124979 A1* 6/2007 Newkirk et al. ..... 42/70.11
2008/0000130 A1* 1/2008 Mauch et al. ..... 42/70.11
2009/0037374 A1* 2/2009 Delia et al. ..... 707/3
2009/0223354 A1* 9/2009 Root, Jr. ..... 89/1.11

* cited by examiner

175

INTERNATIONAL LAW AND RULES OF WARFARE

1. WEAPONS AND METHODS OF WAR THAT CAUSE UNNECESSARY INJURY ARE PROHIBITED
2. PARTIES REQUIRED TO DISTINGUISH BETWEEN COMBATANTS AN CIVILIANS
3. CANNOT ATTACK PURELY CIVILIAN TARGETS
4. IF MILITARY OBJECTIVE INVOLVES CIVILIANS, MUST EMPLOY METHODS TO MINIMIZE HARM TO CIVILIANS
5. LAW OF PROPORTIONALITY REQUIRES BALANCE BETWEEN EXPECTED MILITARY ATTACK WITH HARM TO CIVILIANS
6. PROHIBITS TORTURE OF COMBATANTS OR CIVILIANS

FIG.5a

176

US LAW AND RULES OF ENGAGEMENT FOR DIRECTED ENERGY WEAPON

1. GENERAL
   - A. SECURE DOCUMENTATION REQUIRED
   - B. GEOGRAPHIC LIMITATION
   - C. TIME LIMITATION
   - D. AUTHORIZATION

2. FOR USE INSIDE THE UNITED STATES
   - A. SENSE TARGET CONDITION, DIFFERENTIATE TARGETS
   - B. AVERSION: TWO-PERSON RULE LEVEL 5, LAW ENFORCEMENT OBJECTIVE
   - C. HIGH PAIN: + GOVERNOR APPROVAL, THREAT TO OTHERS, ONLY ALTERNATIVE IS LETHAL FORCE, CANNOT BE RETREATING

3. ANY WAR ZONE
   - A. AVERSION: GENERAL LEVEL 2 AUTHORIZATION FOR COMBATANTS, IF CIVILIANS REQUIRE MILITARY OBJECTIVE
   - B. HIGH PAIN: + TWO PERSON RULE LEVEL 3, MILITARY OBJECTIVE AND ALTERNATIVE IS LETHAL FORCE OR RISK TO US FORCES, NOT RETREATING
   - C. FOR CIVILIANS, SENSE TARGET CONDITIONS AND DIFFERENTIATE TARGETS

4. SPECIFIC WAR ZONE
   - A. ENUMERATE ALLOWED ZONES OF USE OR PROTECTED AREAS
   - B. ENUMERATE ANY TIME RESTRICTIONS
   - C. SPECIFY PERSONNEL AUTHORIZED TO USE AND AUTHORIZATION LEVEL
   - D. SET POWER LEVEL FOR JUST NOTICEABLE, AVERSION, HIGH PAIN OR SWITCH TO LETHAL METHOD

FIG.5b

199

EXAMPLE OF RULE
WAR ZONE: YES
APPROVE ZONE OF USE: YES, NAVILLAG CITY
REQUESTED USE: AVERSION, BROAD BEAM SIZE FOR CROWD
AUTHORIZATION: YES, LEVEL 3
PEAK SKIN TEMP: 94.6
DIFFERENT IR SIGNATURES: NO, NO ONE RECENTLY TARGETED
RANGE: 200 M, WITHIN EFFECTIVE RANGE OF WEAPON
ADVANCE/RETREAT: MIX?
TARGETS IN FOV: APPROX 20
PERSISTENCE IN FOV: 10 MINUTES
ARMED: YES, SMALL NUMBER
NON-COMBATANT/COMBATANT RATIO: 5/15
ALTERNATIVES: LETHAL FORCE
MILITARY OBJECTIVE: CLEAR MAIN ROADWAY TO HOSPITAL OF INSURGENTS
THREAT LEVEL: MODERATE

RESULTS: ENABLE FOR AVERSION, BROAD BEAM
MESSAGES: IF NOT EFFECTIVE, ENABLE FOR HIGH PAIN IF NARROW BEAM TO SELECT ARMED COMBATANTS.
IF CROWD ADVANCES ON US TROOPS, ENABLE HIGH PAIN BROAD BEAM

FIG.6b

196

AUTHORIZATION

1. OPERATOR
2. AUTHORIZING OFFICER(S)
3. AUTHORIZATION LEVEL
4. DATE STAMP

FIG.7a

197

AUTHORIZATION LEVEL

6. ALL CAPABILITIES
5. HOME COUNTRY, LOW POWER
4. DESIGNATED WAR ZONES, LETHAL
   ** REQUIRES 2ND AUTHORIZATION
3. DESIGNATED WAR ZONES, HIGH POWER
2. DESIGNATED WAR ZONES, LOW POWER
1. LIMITED LOW POWER EMERGENCY AND DEMONSTRATION USES

FIG.7b

195

OPERATING ENVIRONMENT

1. DEVICE GPS COORDINATES
2. ZONE OF USE COORDINATES
3. TIME OF DAY
4. THREAT LEVEL

FIG.8a

198

HUMAN ATTRIBUTES

1. RANGE TO TARGET
2. PERSISTENCE IN ZONE
3. MOVEMENT
4. PEAK TEMP
5. DIFFERENT IR SIGS
6. ARMED
7. RATIO NON-COMBATANTS/COMBATANTS

FIG.8b

194

WEAPON USE

1. REQUESTED USE PARAMETERS: ENERGY LEVEL, BEAM WIDTH, DURATION, EFFECT
2. PAST USE

FIG.8c

RECORDED DOCUMENTATION

200

WEAPON: DIRECTED ENERGY WEAPON TYPE XYZ, SERIAL # ABCD
OPERATOR: CAPTAIN SMITH
AUTHORIZATION: VERIFIED LEVEL 3
WAR ZONE: VERIFIED
ZONE OF USE: NAVILLAG CITY, BOUNDED BY 1ST & 3RD STREETS, 8TH AND 10TH AVE, GPS COORDINATES 00:00:00
DATE STAMP: JANUARY 28, 2007, 3:15AM
THREAT LEVEL: MODERATE
TARGET CLASSIFICATION: UNRULY CROWD, POSES THREAT TO US MILITARY PERSONNEL & ROADWAY TO LOCAL HOSPITAL
TARGETS: ESTIMATED 200 IN ZONE OF USE
ARMED: MIX
RANGE TO TARGET: 200-225M
PERSISTENCE: TARGETS IN ZONE FOR OVER 10 MINUTES
MOVEMENT: SLOWLY MOVING TOWARDS US MILITARY PERSONNEL
IR SIGNATURE: NORMAL
REQUESTED USE: AVERSION, BROAD BEAM
PAST USE: NONE
ALTERNATIVES: US PERSONNEL MAY RETREAT OR USE DEADLY FORCE
RULES APPLIED: U.S. LAW, INTERNATIONAL LAW, LOCAL RULES OF ENGAGEMENT FOR IRAQ, THREAT LEVEL MODERATE
ENABLE/DISABLE DECISION: ENABLE FOR AVERSION, BROAD BEAM
MESSAGES: IF NOT EFFECTIVE, ENABLE FOR HIGH PAIN IF NARROW BEAM TO SELECT ARMED COMBATANTS.
IF CROWD ADVANCES ON US TROOPS, ENABLE HIGH PAIN BROAD BEAM
EFFECT ON TARGET: STOPPED ADVANCE, TARGETS AGITATED BUT NOT DISPERSING

FIG.9

SAFEGUARD SYSTEM FOR ENSURING DEVICE OPERATION IN CONFORMANCE WITH GOVERNING LAWS

BACKGROUND OF THE INVENTION

1. Field of the Invention

This invention relates to devices whose misuse may discomfort, harm or otherwise violate the legal rights of a person, and more specifically to a safeguard system for ensuring device operation in conformance with governing laws.

2. Description of the Related Art

As technology advances, new devices are being constantly developed that provide great capability to interact with people. The sophisitcation of these devices allows them to be highly intrusive and push the envelope of what use conforms with the governing law and what use violates the legal rights of a person or persons. In many circumstances, these devices may provide a very valuable service or function to the military, law enforcement, medical community or the person themselves. However, concerns that the devices may be intentionally, negligently or accidentally misused and violate the legal rights of a person may curtail the use of such devices. Companies or countries may choose not to adopt the devices based on these concerns. Laws may be targeted at preventing the production and use of such devices or complicated and costly controls may be required. To further complicate matters, the legal and appropriate use of such devices may change with circumstances.

Raytheon Missile Systems is currently developing an 'active denial system' that uses a directed energy weapon to transmit a nonlethal millimeter wave beam of electromagnetic energy. The beam penetrates a person's skin to about 1/64 of an inch and has the effect of rapidly heating a person's body temperature to about 130° F. causing a very painful sensation within a few seconds of exposure. The weapon has been demonstrated to be highly effective to disperse crowds of people or individuals without causing permanent pain or harming the people in any way. The weapon provides an alternative to doing nothing, using conventional crowd control techniques that endanger US forces and risk escalation or using harmful or lethal force. However, there are serious concerns regarding the potential misuse of such a weapon that would violate the human or legal rights of people. For example, the weapon could be used in an area, at a time or at a threat level that does not warrant its use. The operator may use the weapon to deliver too much energy or to illuminate too wide an area. Furthermore, the weapon might fall into the wrong hands of those who may use it indiscriminately. The active denial system represents a great advancement in weapons technology and the possibility to be a very effective and humane weapon if the concerns regarding misuse can be addressed.

Advances in surveillance technology are providing law enforcement with a much improved and expanded capability to conduct surveillance on people (or their property) in their homes, cars, on the street or in airports. This technology may prove to be very useful in investigating criminal activity and preventing terrorist attacks. However, the technology raises questions of privacy rights, what constitutes a search and what types of surveillance techniques are justified with a warrant. General advancements in technology provide for standard audio and video surveillance from much greater distances. Furthermore, advances in imaging technology provide for IR imaging of heat signatures, wall penetrating and clothing penetrating systems, and RF imaging that can be considerably more invasive of a person's privacy or body. If these technologies cannot be implemented in a manner that guarantees that people's legal and civil rights will be protected, it is possible that the use of such technology will be banned or highly restricted.

The conflict between exploiting the benefits of new technology while ensuring people's legal rights will grow as technology advances in the areas of weapons and surveillance systems as well as public safety or health care for example. There is a need for a sophisticated safeguard system that can ensure use of the device in conformance with the governing laws based on the applicable and changing circumstances.

SUMMARY OF THE INVENTION

The present invention provides a safeguard system for ensuring device operation in conformance with governing laws for devices whose misuse may discomfort, harm or otherwise violate the legal rights of a person.

This is accomplished with a safeguard system that implements a legal protocol for using the device(s) in conformance with the governing laws. The legal protocol is defined by rules embodying the laws that govern the use of the device and require as inputs an authorization to use the device and input condition(s) relating to at least one of a use of the device, an attribute of a human target of the device and an operational environment of the device and human target. The system may include means for updating the rules from an external and possibly remote source. An authorization system provides the authorization to use the device. Authorization may require a chain of authorization including possibly remote authorization and may be multi-valued to provide different levels of authorization for using the device. The input condition related to the use of the device may, for example, be the current requested use of the device or a past use. The attribute of the human target may, for example, be the location, movement, persistence, identity, physical condition or an effect of the past use of the device on the human target. The operational environment may, for example, be the location of the device, a zone of use for the device, a time of requested use, a movement of the device or an urgency level. A variety of sensors are deployed and coupled to the safeguard system to provide the sensed input conditions. The safeguard system applies the rules to the authorization and input condition(s) to generate a control signal that ensures the device is used in conformance with the legal protocol. The control signal may simply enable/disable the device for the requested use or may configure the device so that its use conforms to the legal protocol. The safeguard system suitably includes a documentation system that records the authorization, input condition (s) applied rules, control signal and a sensed effect on the human target, which may include means for communicating the documentation to a remote location. The safeguard system also suitably includes rules for detecting tampering and for taking remedial action.

In an embodiment, the safeguard system is employed to control a directed energy weapon adapted to illuminate human targets with a directed energy beam. The beam penetrates and rapidly heats a person's skin causing them to flee the path of the beam. The rules are configured to embody, for example, the international, US, and military laws and local rules of engagement for the use of the directed energy weapon. The requested use of the device would, for example, specify a desired effect on the target. The operational environment may determine the requested zone of use and the existing threat level in that zone. The human attributes are of particular importance when considering whether use of the directed energy weapon is merited. The sensed conditions can determine how many targets are in the zone, are they moving toward a protected area, are they armed, have they been recently exposed to the beam and so forth. Whether use of the weapon is justified at all and if so at what energy level under the legal protocol will vary with the input conditions and possibly the authorization. For example, a general may have greater authority than a captain or the general may receive higher authorization by requesting remote authorization up the chain of command. A documentation system suitably records the requested use, authorization(s), input condition (s), applied rules, the control signal and the measured effect of the beam on the targets and may transmit the records to a remote location.

In another embodiment, the safeguard system is employed to control one or more surveillance devices that are used to monitor a target such as a person, a person's home or property or a specified location. The sophistication of current surveillance devices has led to uses that constitute warrantless searches that invade people's privacy and impede lawful investigations and criminal prosecutions. The safeguard system ensures that the surveillance devices conform to the governing laws and any specific court orders. For example, a court order may require certain police offers to conduct the surveillance and specify surveillance only at a specific location and day/time with certain devices. The order may also require a certain condition precedent such as the identification of a particular person(s) before using certain equipment. GPS, time and video sensors can gather this data which is then documented to verify that the court order was followed.

These and other features and advantages of the invention will be apparent to those skilled in the art from the following detailed description of preferred embodiments, taken together with the accompanying drawings, in which:

BRIEF DESCRIPTION OF THE DRAWINGS

FIGS. 5*a*-5*b* are examples of International and US laws, respectively that might govern the use of a directed energy weapon;

FIGS. 6*a*-6*b* are a flowchart and an example of the application of one subset of rules for the directed energy weapon problem;

FIGS. 7*a* and 7*b* are an example of authorization to use the weapon and possible authorization levels;

FIGS. 8*a*-8*c* are examples of input conditions for the operating environment, human attributes and device use, respectively;

FIG. 9 is an example of the documentation generated by the safeguard system for a requested use of the weapon;

DETAILED DESCRIPTION OF THE INVENTION

The present invention describes a safeguard system for ensuring device operation in conformance with governing laws for devices whose illegal misuse may discomfort, harm or otherwise violate the legal rights of a person. The safeguard system will allow such devices to be used effectively in military, law enforcement, public safety, medical and other situations in which concerns over misuse may otherwise prevent their adoption. The safeguard system may be retrofitted to or integrated with weapons systems such as a directed energy weapon, shoulder launched missiles, missiles, bombs, weapons of mass destruction or land mines, surveillance systems including visible, IR, wall penetrating or RF imaging and medical devices that dispense drugs or provide other services.

Figure 1:
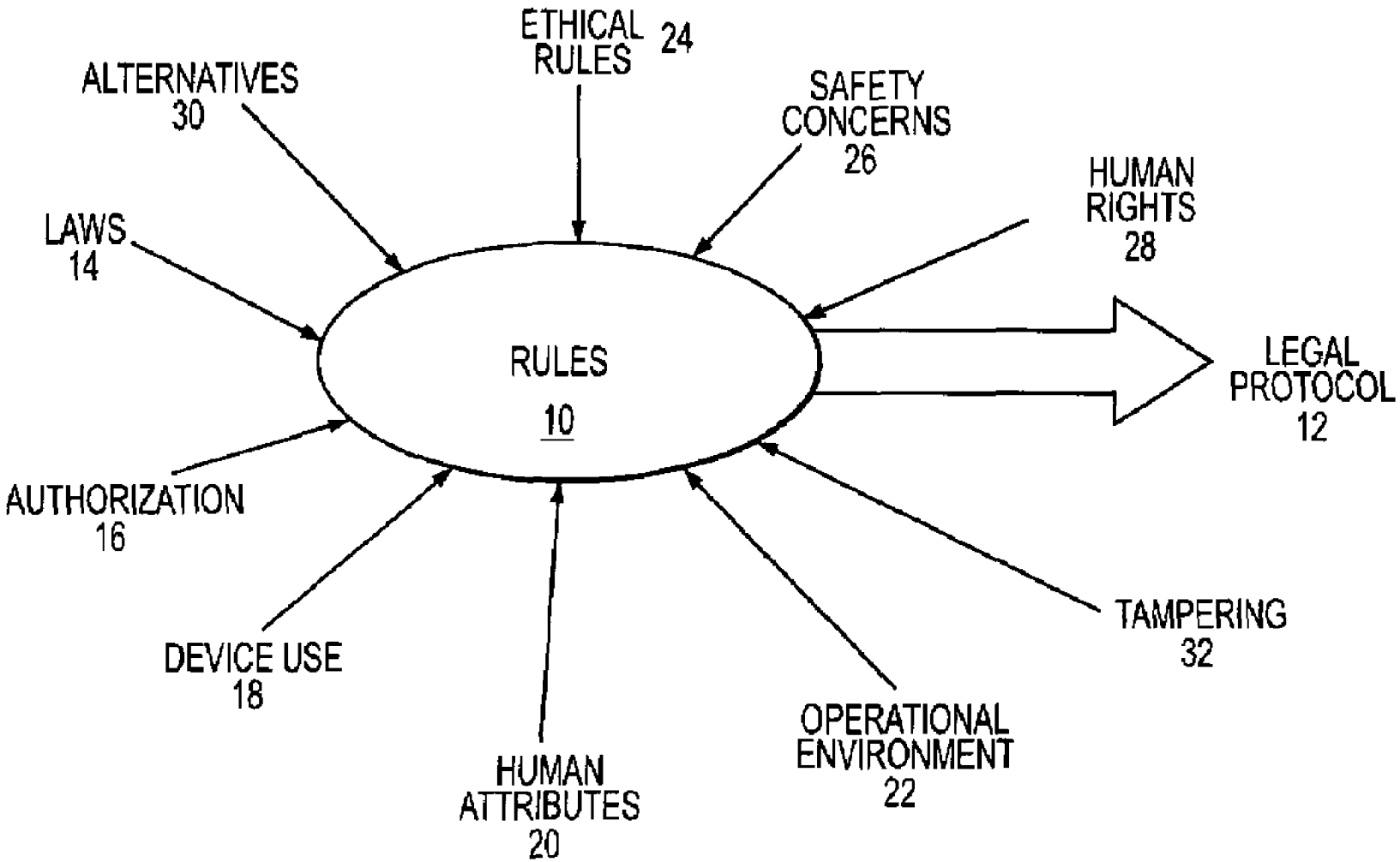
FIG. 1 is a diagram illustrating the various sources of law and other inputs that are embodied in the rules and define the legal protocol for use of a device.

As illustrated in FIG. 1, the safeguard system enforces a set of rules 10 that define a legal protocol 12 for using the device. The rules embody the laws 14 governing the use of the device and inputs including authorization 16 and at least one of device use 18, human target attributes 20 and operational environment 22. The law may include international, country, state, military or other laws. Authorization may require a chain of authorization including possibly remote authorization and may be multi-valued to provide different levels of authorization for using the device. The input condition related to the use of the device may, for example, be the current requested use of the device or a past use. The attribute of the human target may, for example be the location, movement, persistence, identity, physical condition or an effect of the past use of the device on the human target. The operational environment may, for example be, the location of the device, a zone of use for the device, a time of requested use, a movement of the device or an urgency level. For a given authorization and combination of input conditions, the rules will specify what use of the device is allowed under the governing laws. The rules may also embody other factors such as ethical rules 24, safety concerns 26, or human rights 28 that serve to raise the requirements for using the device from the minimum standard provided by the governing law. The rules may also consider what alternatives 30 to using the device exist. The rules may include conditions for detecting tampering 32 with the device or safeguard system and taking remedial action. These rules can be used to either enable/disable the device for a specific requested use or to provide a device configuration that may be used given the current authorization and input conditions. For each requested use, the authorization, input conditions, rules applied, use of the device and any effect on the human target are preferably documented as evidence that the device was used in conformance with the legal protocol and governing laws.

Figure 2:
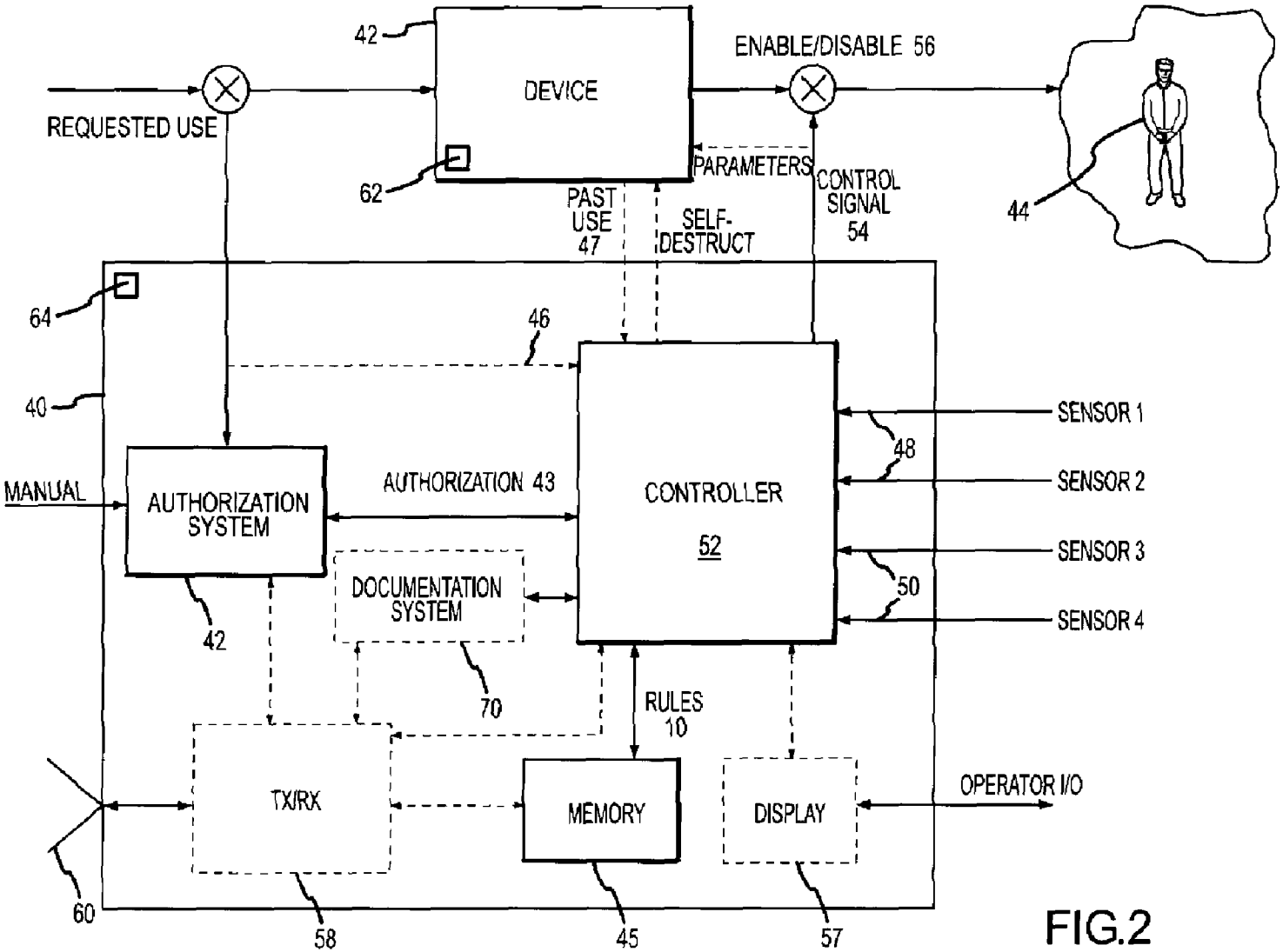
FIG. 2 is a block diagram of a safeguard system for ensuring device operation in conformance with governing laws in accordance with the present invention.

As illustrated in FIG. 2, a safeguard system 40 is configured to implement legal protocol 12 defined by rules 10 to ensure that a device 42 is operated in conformance with the governing laws for operating the device with respect to a human target(s) 44 under different and changing circumstances. As shown, the safeguard system is separate from device 42 as may be representative of a retrofit but it is understood that the safeguard system may be partially or wholly integrated with the device. In addition, a single safeguard system could control and receive decision making data from multiple devices.

An embodiment of safeguard system 40 includes an authorization system 42 that generates the authorization 43, a memory (storage circuit) 45 that stores the rules 10, at least one input relating to the requested use 46 of the device or a past use 47, a sensed attribute 48 of a human target of the device and a sensed operational environment 50 of the device and human target, and a controller 52 (evaluation circuit) that applies the rules 10 to the authorization 43 and input condition(s) 46, 48, 50 to generate a control signal 54 that controls the device 42 in conformance with the legal protocol. In this embodiment, a memory and controller are used to store and implement the rules. In another embodiment the rules could be embodied in, for example, a logic circuit.

The control signal may be used to enable/disable the device or to configure it for an allowable use. In the case of a specific requested use, control signal 54 either enables or disables the device for the requested use. The enable/disable is depicted as a switch 56 at the output of device 42. In other instances, the enable/disable function can be integrated inside the device or may occur at multiple places to enable/disable different features of the device. A display 57 may be included as part of the system to facilitate operator I/O and to display messages that accompany control signal 54. If the requested use is not allowed and the device is disabled, the displayed message may explain why the use was not allowed and/or suggest a use that conforms to the legal protocol. Alternately, the system and rules may be configured to output an allowable or 'optimal' use of the device given the authorization and input condition(s). In this case, control signal 54 would include the parameters required to configure the device for the allowed or optimal use. The former approach allows an operator to request a use for the device based on different factors and verify whether the requested use conforms to the legal protocol. The latter approach allows the system itself to automatically determine an allowed and possibly optimal use under the circumstances.

Authorization system 42 provides authorization 43 for some operating entity to use the device in accordance with the rules and other input conditions. The operating entity is typically a person, maybe the human target, but the device could be configured to operate autonomously. The requested or attempted use of the device will suitably prompt the authorization system to request authorization. The authorization itself may be a single authorization by a person operating the device or directing another person to operate the device or it may be a chain of authorizations some of which may be requested and received from a remote location. Authorization may be a simple binary yes or no or it may be multi-valued providing for different levels of authorization. Local authorization may be obtained by manual entry of a code or via biometric sensors. Remote authorization may be obtained via a transceiver 58 and RF antenna 60 or over a wired or wireless Internet connection. This remote communication capability may also be used to update the rules 10 stored in memory 45 or to modify the authorization codes or levels in the rules.

The safeguard system via display 57 or other operator I/O may allow the operator to enter data on input conditions that might effect the decision on whether to enable/disable the device. This provides for some flexibility that only a human operator can provide; information for a disabled sensor or verification of sensed conditions. The system may also provide for a manual override in urgent situations.

The safeguard system may also include sensors 62 and 64 located on the device and safeguard system, respectively, and rules for detecting tampering and taking remedial action. If someone tries to tamper with the device or safeguard system or to disable the safeguard system the sensors would provide an input to the controller. The rules could than cause the device to be temporally or permanently disabled, to self-destruct and/or to transmit a message regarding the tampering. Furthermore, the rules may be written in such a way as to detect other forms of tampering or misuse. For example, if the device is expected to remain stationary and it starts moving without proper authorization, the rules may detect this as tampering.

To ensure public confidence and to protect the operator, an important additional feature of the safeguard system is a documentation system 70. The documentation system preferably records each requested use of the device and stores the data so that it cannot be destroyed or altered. As each use is recorded or at periodic intervals, the documentation may be transmitted via transceiver 58 and antenna 60 to a remote location. The system suitably records each requested use, the authorization(s), input condition(s), applied rules, control signal and any sensed effect on the human target. The documentation provides a complete record illustrating the use of the device in conformance with the legal protocol.

Figure 3:
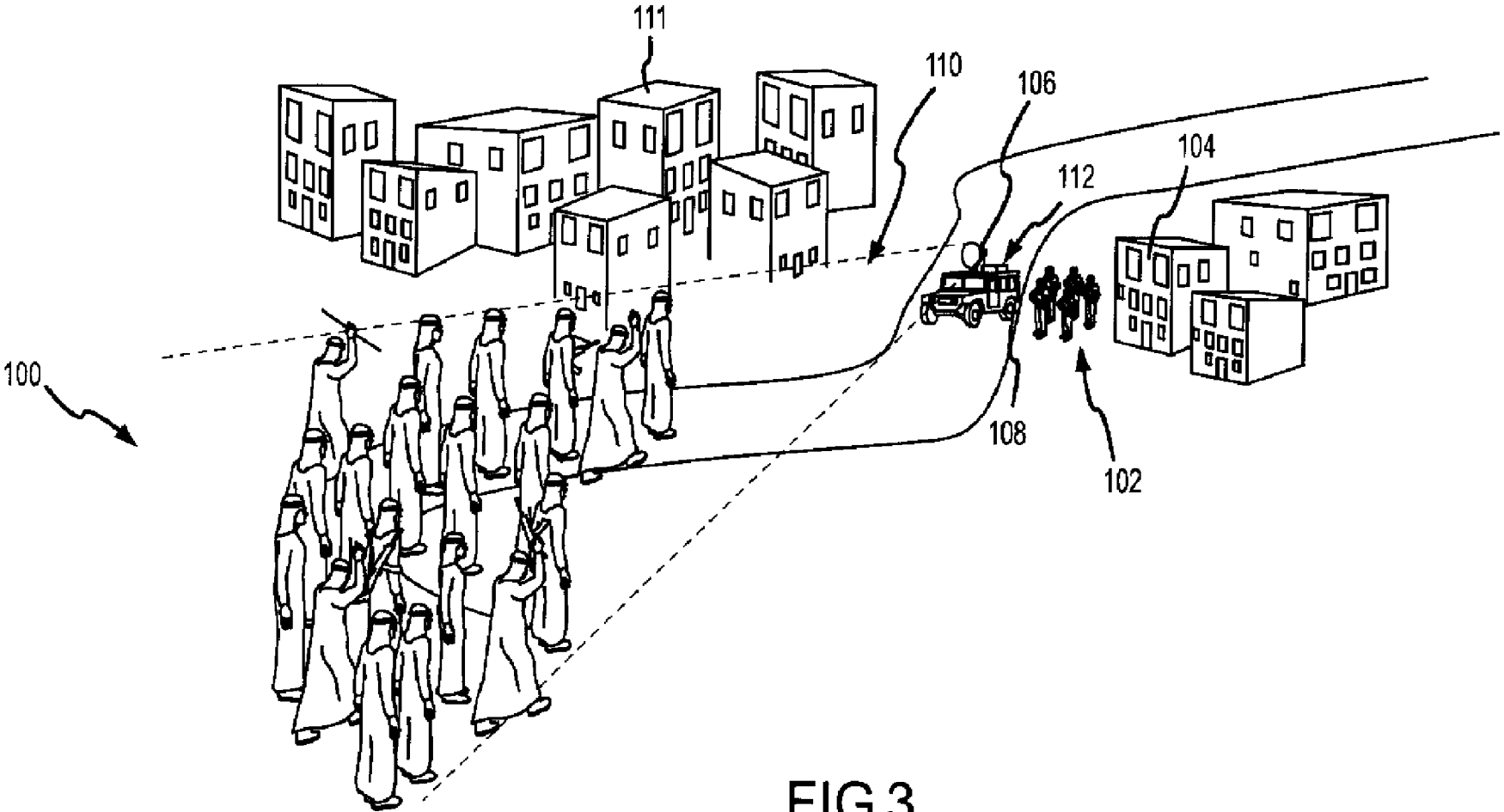
FIG. 3 is a diagram depicting an urban environment in a military zone in which a safeguarded directed energy weapon is deployed.
Figure 4:
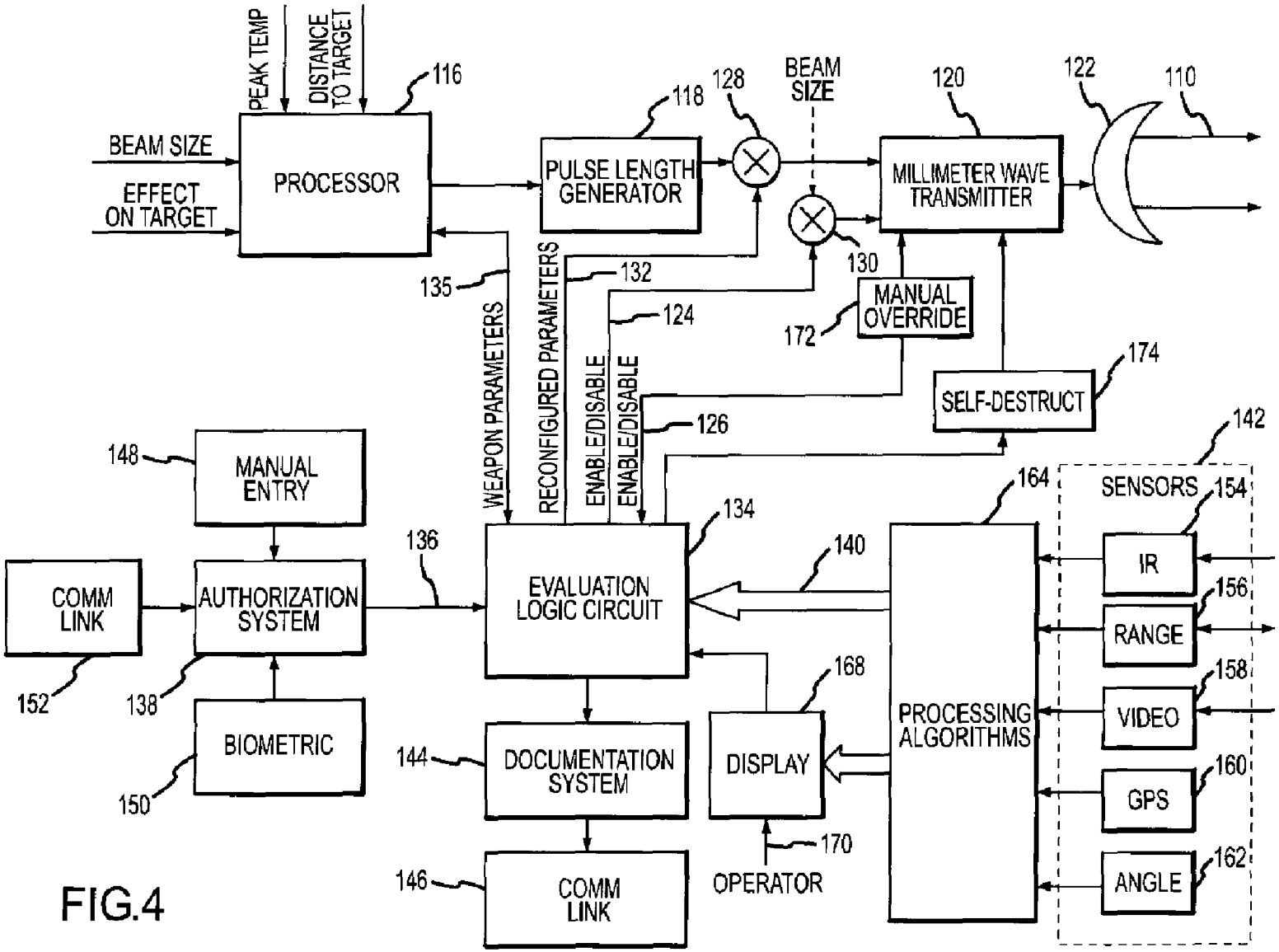
FIG. 4 is a hardware block diagram of an embodiment of a directed energy weapon and safeguard system.

A safeguard system for use with a non-lethal directed energy weapon is illustrated in FIGS. 3 and 4. An exemplary urban battlefield scenario 98 is depicted in FIG. 3, in which UN forces have been deployed to a foreign country on a peace keeping mission in attempt to separate and calm two religious warring factions. A crowd of people 100 from faction A have gathered to peacefully protest the policies of faction B. UN peacekeepers 102 monitor the protest. At some point the protestors decide to escalate their protest and leave their part of the city to march down the main street towards the three embassies 104 at a critical time. If the protest is allowed to reach the embassies, violence is certain to occur and likely escalate throughout the city.

Ordinarily the peacekeepers would have three choices, all of them bad. First, they could continue to observe and do nothing. Second, they could put themselves physically between the warring factions and try to hold the crowd at bay, which places the peace keepers at great risk. Thirdly, they could use deadly force to push back the crowd. However, the use of deadly force may not be authorized by their charter and specifically not justified at this point. A directed energy weapon 106 mounted on a humvee 108 provides a fourth and better option. The directed energy weapon transmits a directed energy beam 110 that penetrates the skin of anybody in its path causing their skin to get very hot very quickly. The crowd will disperse and return to their part of the city without suffering permanent harm, putting the peacekeepers at risk or risking escalation of the confrontation with either the peacekeepers or the rival faction. Other embassies 111 near by would have their coordinates protected and the system would not be allowed to fire at them.

Although the directed energy weapon is well suited for this scenario there is considerable potential for actual or alleged misuse. To achieve their mission it is important that the peace keepers treat both sides fairly in fact and in perception and be able to document this fair treatment. The directed energy weapon in normal operation leaves no visible evidence of use and thus it could be used improperly with no evidence or people could allege the weapon was used improperly when it wasn't. The directed energy beam is a very powerful weapon that if used on a person for too long or at too high a power could possibly injure the person. Furthermore, in any UN peacekeeping mission the applicable laws and rules of engagement for the use of force, particularly a 'ray gun', may be quite complex. Who is authorized to use the weapon? Where can the weapon be used? Under what circumstances is use justified? What energy levels are allowed? The possibility that an operator may accidentally, negligently or intentionally misuse the weapon under such complex and changing circumstances is a real and valid concern. The likelihood that the peace keepers will be accused of misusing the weapon is also a real concern. Both have presented considerable obstacles to the adoption of the directed energy weapon.

A safeguard system 112 in accordance with the present invention can be retrofitted to existing weapons or incorporated into the weapon and carried on the humvee 108. The safeguard system will automatically ensure that the weapon is used in conformance with the legal protocol and governing laws for the peacekeeping mission and that all instances of its use are securely documented.

In this one scenario a number of different factors will determine the rules and how those rules are applied under the circumstances. The rules must embody international law and any rules of engagement that may have been adopted for this particular mission. For example, the 'rule of proportionality' under international law calls for a reasonable relationship between the amount of destruction caused and the military significance of the attack. The rules of engagement may specify that the first shot must be at the lowest energy level, e.g. a 'warning shot', may limit the areas in which the weapon can be used, the times of day, the minimum or maximum size of a crowd, require that the crowd be within a certain range and moving towards a protected area, be armed, place a limit on total energy exposure to any one person or many other circumstances. The rules may require a soldier of a certain rank to operate the weapon and may only allow higher ranking soldier's to use the weapon at higher energy levels, to manually override the safeguard controls, or to use the weapon in certain sensitive areas.

The architects of the rules for the safeguard system for use with a directed energy weapon will have to synthesize all of these laws and inputs into a set of hierarchical rules that govern the use of the weapon. These rules would be legally vetted to ensure that if they are followed they use of the weapon conforms to the governing laws. For example, representing the 'rule of proportionality' as a rule or set of rules that can be automatically executed by a computer or logic circuit under varying battlefield conditions requires certain decisions to be made, e.g. what threat justifies what beam energy? A general set of rules that conforms weapons use to international and US law may be stored in each weapon and additional rules for a given conflict uploaded as the rules are generated and the weapon is deployed. At a minimum, the rules embody the laws that govern the use of that weapon and require as inputs an authorization and at least one sensed attribute of a human target to assess whether use of the weapon is merited. The safeguard system will not allow the weapon to be fired without proper authorization and without some condition of the human target(s) be it temperature, range, movement etc.

An embodiment of a safeguard system 112 integrated with a directed energy weapon 106 is illustrated in FIG. 4. In this simplified schematic, the weapon transmits a beam 110 at a constant power level and variable beam size. The total energy delivered to a target is controlled by modulated the pulse length of the beam. Beam size is controlled by focusing the beam for a given power density or effect at a certain distance. Alternately, the weapon could be configured to transmit a variable power, constant pulse or both. The weapon includes a processor 116 that computes the total energy needed on the target given inputs of a specified effect on target, a beam size, a distance to the target and a peak skin temperature of the target. The first two inputs are typically specified by the operator, although in a fully automated configuration the safeguard system could determine allowed or optimal parameters. The last two inputs are sensed attributes of the human targets. The specified effect on the target can be, for example, simply low/medium/high or just noticeable, aversion, or temporary high pain. The beam size can be controlled to target a single person or a crowd of people. A pulse length generator 118 adjusts the pulse length for a given power level to deliver the total energy. A millimeter wave transmitter 120 receives the beam size and pulse length and generates the millimeter wave beam 110 transmitted by antenna 122. An operator can fire a shot, gauge the effect on the target and fire another shot at the same or different settings or direct the beam at a different target.

In this configuration, safeguard system 112 receives an authorization and sensed conditions for at least one attribute of the target and possibly the operating environment and applies the rules to those inputs to generate control signals that control the pulse length and/or beam size input to the transmitter. The system can be configured to either generate control signals 124 and 126 that enable/disable 'switches' 128 and 130, respectively. If the switches are enabled, the transmitter fires beam 110. If the switches are disabled, the transmitter does not fire. Alternately, the system can be configured to output reconfigured parameters (effect on target, beam size) 132 to ensure that the beam 110 conforms to rules under the present circumstances.

Safeguard system 112 includes an evaluation logic circuit 134 that implements the rules embodying the laws governing the use of the directed energy weapon. The circuit receives requested weapon parameters (effect on target, beam size) 135, an authorization 136 from an authorization system 138 and sensed conditions 140 from one or more sensors 142 and applies those input to the logic to generate the control signals. The circuit verifies all necessary authorization, assures particular targets are not subjected to improper energy levels and prevents use in authorized areas all under varying circumstances. The circuit assures that the authorizations, input parameters, sensed conditions etc. are passed to a documentation system 144 that logs and transmits the data via a communication link 146 to a remote location for safekeeping.

Authorization system 138 may include means 148 for the operator to manually enter a code or means 150 to authorize the operator using a biometric trigger. In either case, the system verifies the operator against codes or names stored in the system to generate the authorization 136. The authorization can be a simple yes/no or it can be a multi-valued authorization that gives certain operators greater authorization to use the weapon than others. The authorization may be a single step or may require one or more persons (or computers) in the chain of command for a valid authorization. A communication link 152 can be used to request and receive proper authorization.

Sensors 142 include, for example, an IR sensor 154, a laser range finder 156 and a video camera 158 that are configured to sense attributes of the human target and, for example, a GPS sensor 160 and angle (azimuth/elevation) sensors 162 that are configured to sense conditions of the operating environment. Other sensors such as Identify Friend or Foe (IFF), RF sensors, etc. could also be incorporated. Processing algorithms 164 are then applied to the raw sensor data to extract relevant information and put it in a format for input as sensed conditions 140 to the evaluation logic circuit. For example, IR data can be processed to extract a peak skin temperature for a given target or temperatures for multiple targets. A specific range to a given target, the motion of a target and the location of a target relative to a zone of use can be extracted from the range data. Background level, target movement, estimated range, potential targets, target persistence in the field of view, targets that are carrying weapons, and aim point data can be extracted from the video signal. The GPS, angle and range information can define a very specific zone of use that allows for very tight control over the weapon. In some cases, the rules may be configured to only allow the weapon to be used within the defined zone. The evaluation logic circuit 134 applies the rules to some or all of this sensed information to generate the control signals. The rules may be configured to enable/disable the weapon if certain sensors are not functioning or if conflicting information is being report. Alternately, if the authorization is sufficiently high, the rules may allow the weapon to be fired even in the face of sensor dropout or conflicting information.

The information may also be directed to a display 166 for viewing by the operator 170. The safeguard system may be fully automated or may allow or even require an operator to assess displayed sensor information and make certain observations or decisions to augment or verify the sensed conditions input to the logic circuit and the documented record. For example, the operator may have to enter a military objection and some brief description of the situation. The display may present a menu of options for the operator to select to ensure that the military objection is in a format compatible with the rules. The operator may have to estimate the number of targets, ratio of combatants to civilians, number of armed targets from the video, if this cannot be done algorithmically. If a sensor is not working and its input is required to enable the weapon, a properly authorized operator may be allowed to observe and enter the condition. In an extreme case, the conditions may warrant using the weapon to deliver lethal force. In such a case, the legal protocol may require a highly authorized officer to verify some or all of these conditions. The allowed use of force may change with 'threat level'. The threat level could be determined by an external source or authority and communicated to the circuit, the sensor data could be synthesized to assign a threat level or the operating officer could be charged with providing and/or verifying the threat level. The system may allow a properly authorized operator to manually override 172 the safeguards and fire the weapon. The system may limit the total energy per shot or the number of shots under a manual override condition. Any manual override is also passed through the logic circuit to the documentation system. The system also assures that the weapon is rendered either temporally or permanent inoperable if the system is tampered with, improperly used or falls into the hands of unauthorized operators. A self-destruct mechanism 174 can be controlled by an authorized operator, the logic circuit, tamper switches on the weapon or safeguard system or remotely.

For purposes of illustration, we will walk through representative international and US laws, authorization, sensed conditions, an exemplary application of a subset of rules and the documentation another simple scenario for the use of the battle field weapon as shown in FIGS. 5-9. The examples given are not intended to be complete or represent actual law or rules, but rather to illustrate the application of the safeguard system to the directed energy weapon.

As shown in FIG. 5*a*, international law and accepted rules of warfare 175 are generally very broad statements. For example, what constitutes "unnecessary injury", distinguishes a 'combatant' from a 'civilian', constitutes a 'purely' civilian target, is a reasonable military objective, is a proper balance of military need and harm to civilians and constitutes torture. Specific definitions, rules and standards have evolved over time to become well accepted my most countries. An example of possible US law and rules of engagement 176 for the directed energy weapon is provided in FIG. 5*b*. In this example, every use of the weapon would require documentation, geographic and time limitations and proper verified authorization. Again, the specific definitions and standard would have to be specified for different circumstances. For use inside the US, any use would require the capability to sense target conditions and to differentiate targets to minimize the chance of targeting the wrong person or exposing a person to too much energy. For even an aversion level effect, there would have to be a legitimate law enforcement objective and two people with level 5 authorization (See FIG. 7*b*) would have to authorize the use. To use the weapon to temporally inflict high pain, would additionally require the approval of the governor, no alternative except lethal force and that the targets were present a real threat and not retreating. The actual laws and rules of engagement will be far more complicated to address all the possible scenarios. In a war zone, the required authorization and sensed attributes of the target are not generally as stringent. For a specific war zone, the rules of engagement would enumerate the allowed or protected zones, any time restrictions, specify the authorized personnel and level of authorization, and set the power levels for the different desired effects.

Figure 6A:
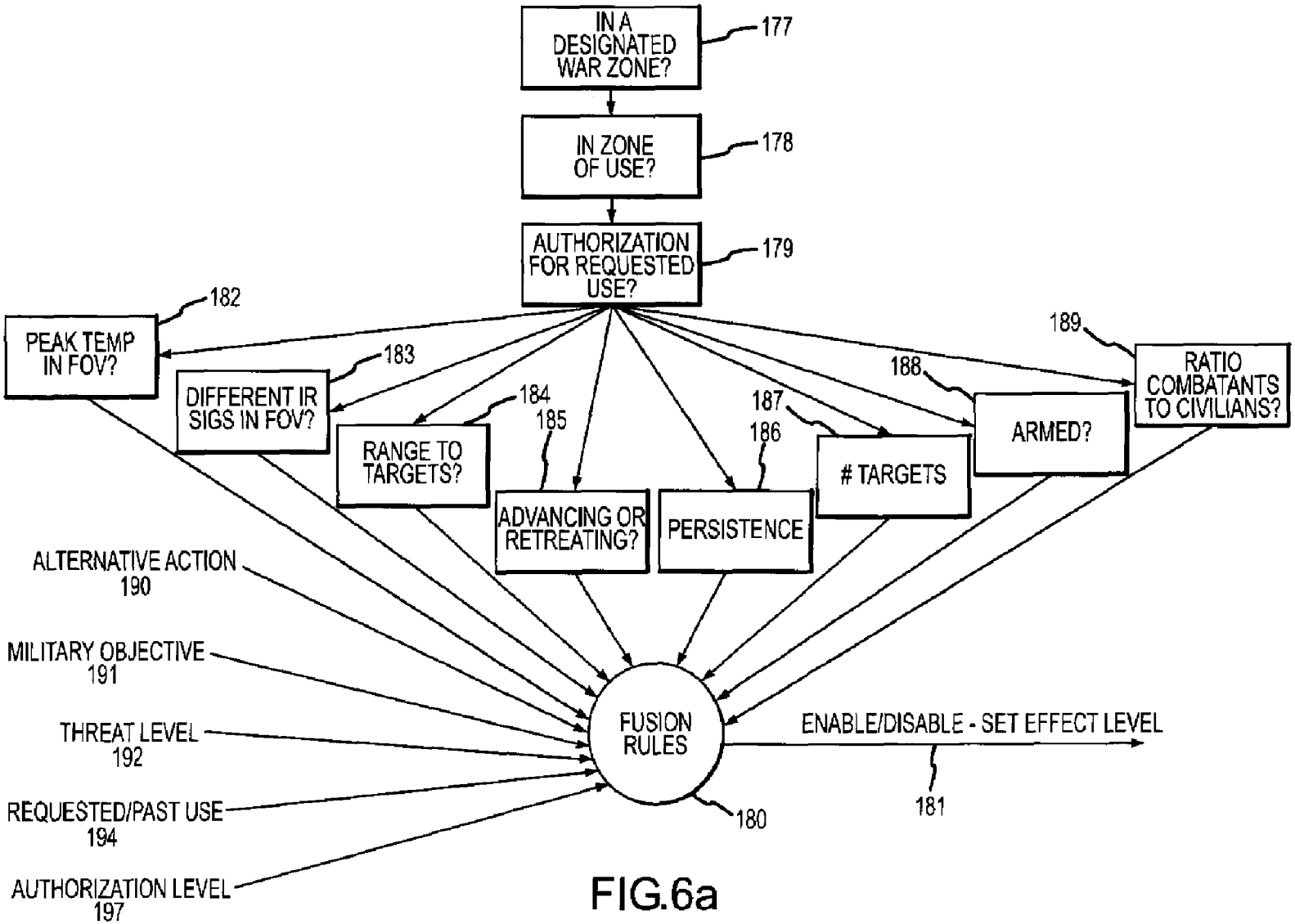

The laws and rules of engagement for the use of a directed energy weapon must be broken down into a sequence of steps or rules to be implemented by a computer or logic circuit. Any number of different programming techniques could be used to construct a set of rules to implement the governing laws. A simplified flowchart of a possible approach is illustrated in FIG. 6*a*. Upon issuance of a request to use the directed energy weapon, the safeguard system determines whether the weapon is in a designated war zone (step 177) and whether in an authorized zone or use or conversely a protected area (step 178). This requires that the rules be programmed with designated war zones, authorized zones etc. A GPS sensor coupled to the safeguard system provides coordinates that can be verified against the programmed coordinates. Other input conditions related to the operating environment 195 may be sensed and verified as shown in FIG. 8*a*. The safeguard system determines whether the operator has proper authorization for the requested use (step 179). A verified authorization 196 may, for example, include the operator's name and identifying info, the names of any other authorizing officers in the chain, an authorization level for the operator and a date and time stamp as shown in FIG. 7*a*. Possible authorizations 197 are shown in FIG. 7*b*.

At this point the safeguard system has determined whether the weapon is located in an authorized area and the operator is authorized for the requested use. The next step is to gather the sensed input conditions from the various target sensors to determine whether the proposed use of the weapon is legally justified by the circumstances. In this particular embodiment, the safeguard system uses the sensed input conditions 198 of attributes of the human targets (FIG. 8*b*) to answer a sequence of questions. The answers are then fed into a node comprised of rules that fuse the answers with other inputs (step 180) to generate the control signal 181. The safeguard system uses IR sensor data to determine a peak skin temperature in the field of view (FOV) (step 182) and IR signatures for different targets in the FOV (step 183), uses the range finder data to determine a range to target (step 184), and uses video sensor data to determine whether targets are advancing targets are advancing or retreating (step 185), persistence of targets in the zone (step 186), number of targets (step 187), whether targets are armed (step 188) and to estimate the ratio of combatants to non-combatant civilians (step 189). The fusion node takes this information plus other inputs such as possible alternative actions 190, the military objective 191 of the requested use, the threat level 192, the operator's authorization level and use of the weapon 194 include the requested use and possibly past use (FIG. 8*c*) and applies it to a set of rules designed to ensure that any use conforms to the governing laws. The rules may output a simple enable/disable as the control signal 181 or may be configured to output an allowed or an optimal allowed use of the weapon. Optimal could be the energy level and beam width best calculated given all the inputs to conform to the governing laws and to achieve a requested effect on the target. Alternately, optimal could mean the maximum use of the weapon allowed by law under the circumstances.

A simple example 199 of the application of the rules is illustrated in FIG. 6*b*. The safeguard system verifies that the weapon is located in a war zone and in an approve zone of use, Navillag City. The system then verifies that the operator is authorized and that his authorization level 3 is sufficient for the requested use of a broad beam aversion on a crowd of people in a war zone. The system verifies that skin temperature is normal at that there is no variation in IR signatures indicating that the targets have not been recently irradiated. The system verifies that the targets are in range. The visual data indicates approximately 20 targets that have been in the zone for about 10 minutes with some advancing and retreating. A small number of the targets are armed and the ratio of non-combatants to combatants is 5/15. The military objective is to clear a main roadway to a local hospital of insurgents and the only alternative is the use of lethal force. The threat level to forces is moderate. The rules fuse all of this information and determine that the requested use of a broad beam, aversion level effect conforms to the governing laws. The system also provides a message for the operator indicating that if the aversion is not effective, a high pain effect would be approved if the beam was narrowed and target to armed combatants. If the crowd advances raising the threat level to the troops, a broad beam on a high pain setting would be warranted. As shown in FIG. 9, the requested use, authorization, sensed conditions, etc are recorded in a document 200. This document is suitably transmitted to a remote location after every use or at periodic intervals.

Figure 10B:
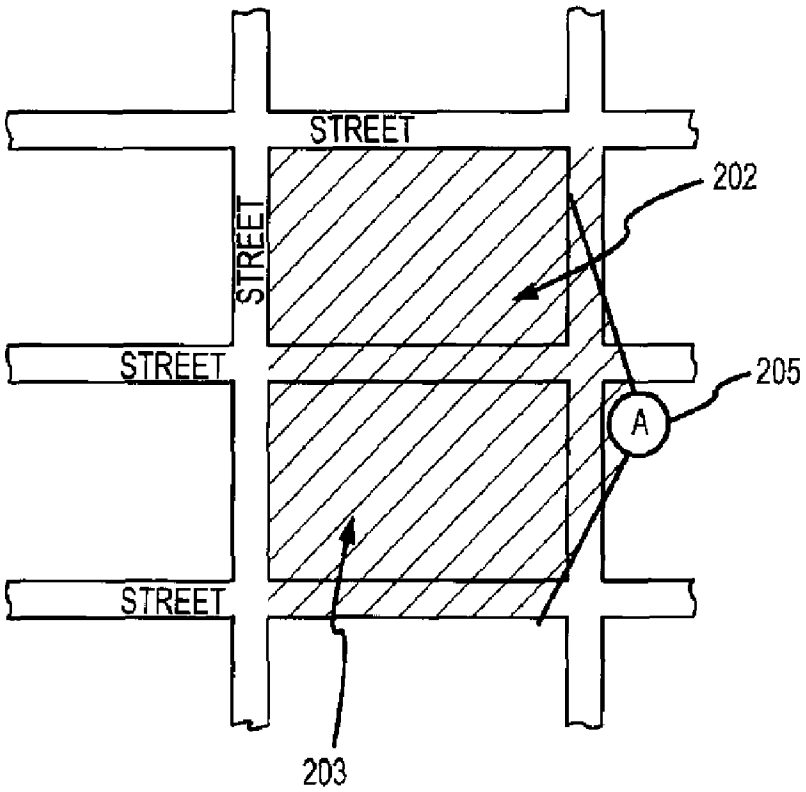
FIGS. 10*a*-10*b* are diagrams illustrating conformance of the weapon's use to a zone of use.
Figure 10A:
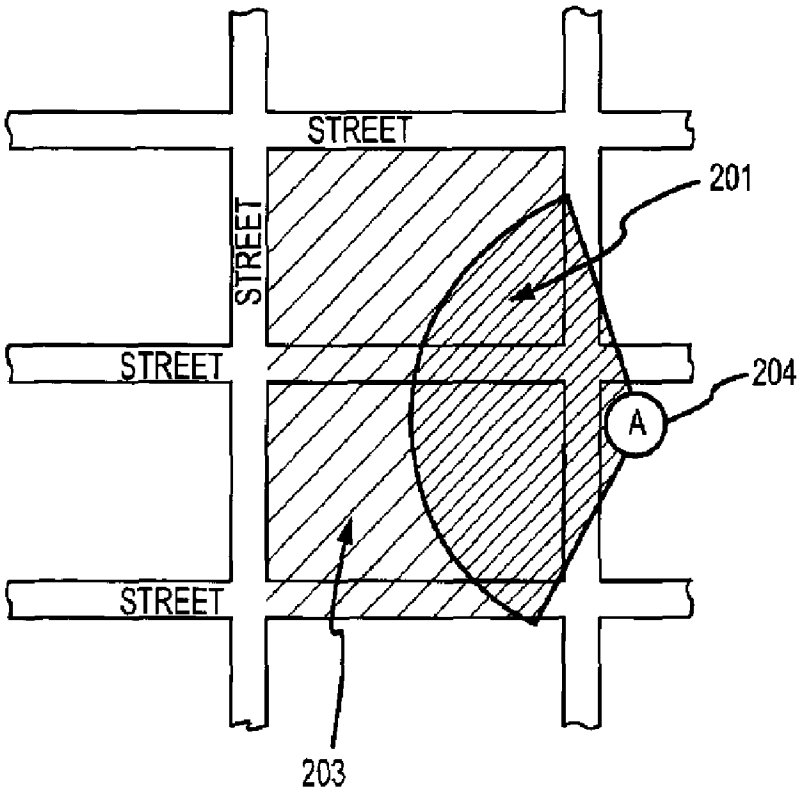

FIGS. 10*a* and 10*b* illustrate how the weapon's authorized fire pattern 201 and 202 can be controlled to an authorized zone of use 203 defined by its GPS coordinates. In the example shown in FIG. 10*a*, a weapon 204 is provided with a sensor that provides GPS coordinates and the angle the weapon is pointed. Between the GPS coordinates of the weapon and the angle information, the rules can effectively limit use 201 to the authorized zone of use. Furthermore, an elevation sensor could provide additional discrimination to, for example, only allow the beam above or below 10 feet. In the example shown in FIG. 10*b*, a weapon 205 is provided with sensors that provide GPS coordinates, range, and sensor azimuth and elevation. With the additional range information, the weapon's fire pattern 202 can be made to correspond more closely to the authorized zone of use 203. When the sensor is pointed in a direction that the range finder indicates is beyond the authorized zone, weapon firing is prohibited. The distance the beam is going to shoot is determined with an eye safe laser rangefinder that is co-bore sighted with the directed energy beam. A sighting display can be implemented to show the operator both a map of the operational zones and a video sight that depicts in what area the unit can be operated. With enough GPS coordinates, other transmitted data, or video recognition of uniforms for example, the non-lethal weapon can be prevented from firing at particular targets that for example are friendly. The camera has tracking algorithms to identify a person just radiated but allow a different person out of the original beam to be radiated. The weapon could be mounted on a gimbaled mechanism that automatically detects, tracks and, if authorized, fires upon targets that enter the authorized zone 203.

Figure 11:
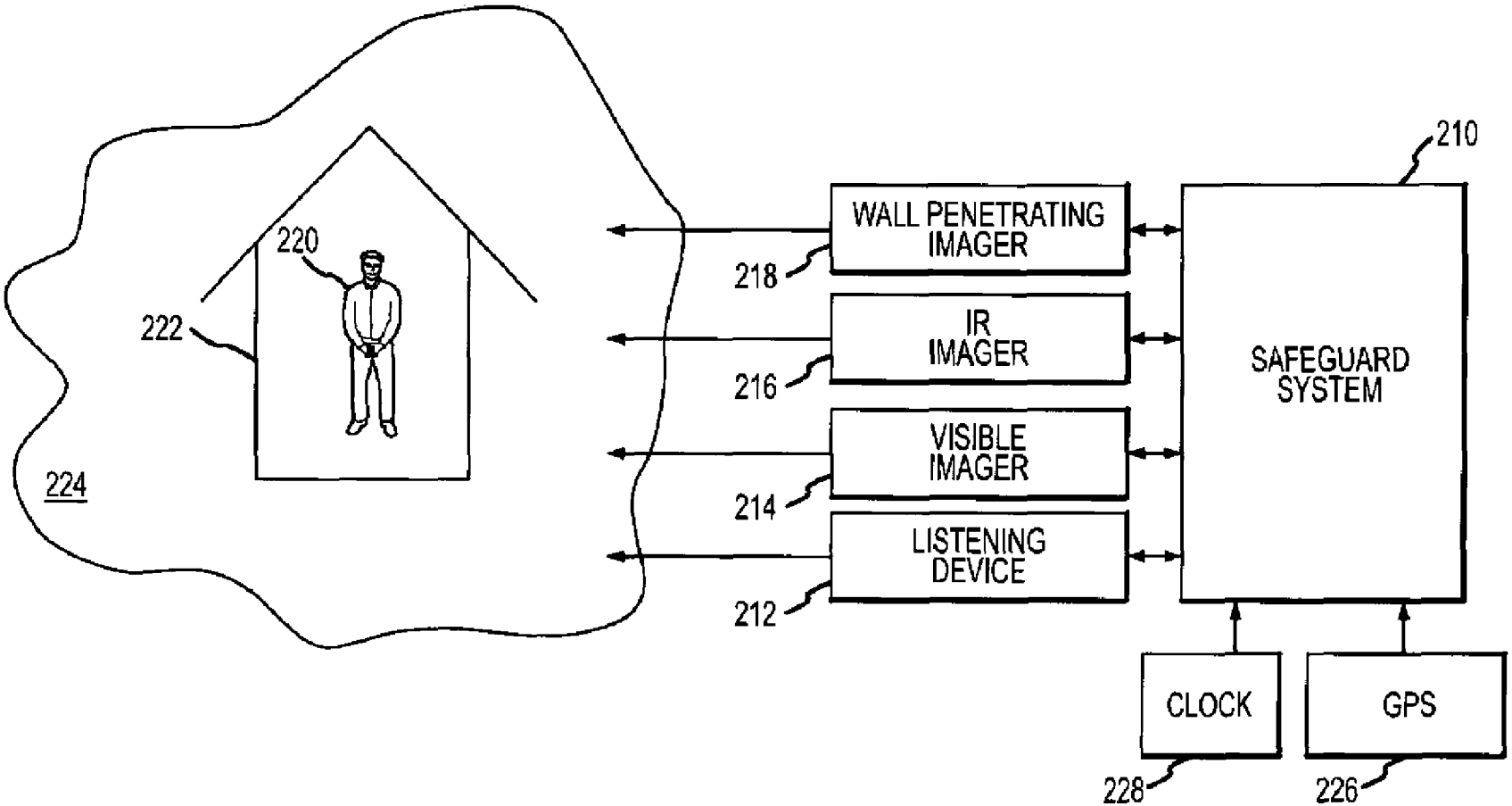
FIG. 11 is a diagram of a safeguard system for surveillance.

As shown in FIG. 11, a safeguard system 210 can be configured for use with one or more surveillance devices such as a listening device 212, a visible imager (still/video) 214, an IR imager 216 and a wall penetrating imager 218. In this example, the surveillance devices are directed at surveilling a human target 220 and his home 222. In other applications, these or other surveillance devices could be used to surveil the target in other locations, the target's personal property such as in air ports, containers etc.

The safeguard system is provided with a set of rules that define any general laws for the city, state or country for each surveillance device and any specific rules such as provided in a warrant or court order for this particular surveillance. For example, the warrant may require two named police officers be present and authorized to use the equipment. The warrant may specify a particular address (zone of use) and minimum distance from the home (range). The warrant may further specify that surveillance can only occur at certain times of day for all or certain equipment, only if the target is at home, only on the curtilage 224 around the home or upon some condition precedent, e.g. the presence of another named target. The authorization system can be configured to recognize biometric IDs of the two officers and require that the biometric ID be updated every hour. A GPS sensor 226 can provide coordinates to verify the target address and possibly the range between the sensors and home. A clock 228 can provide the day and time. The safeguard system can use the surveillance devices themselves as sensors to provide sensed input conditions to verify if the target is at home or if a condition precedent has occurred. The safeguard system will then either enable/disable or configure each surveillance device in accordance with the rules and sensed conditions to execute the warrant. As before, the authorization, sensed conditions, applied rules and information gathered by the devices is recorded to provide documentation that the surveillance devices were used in accordance with the governing laws and any warrant.

Figure 12:
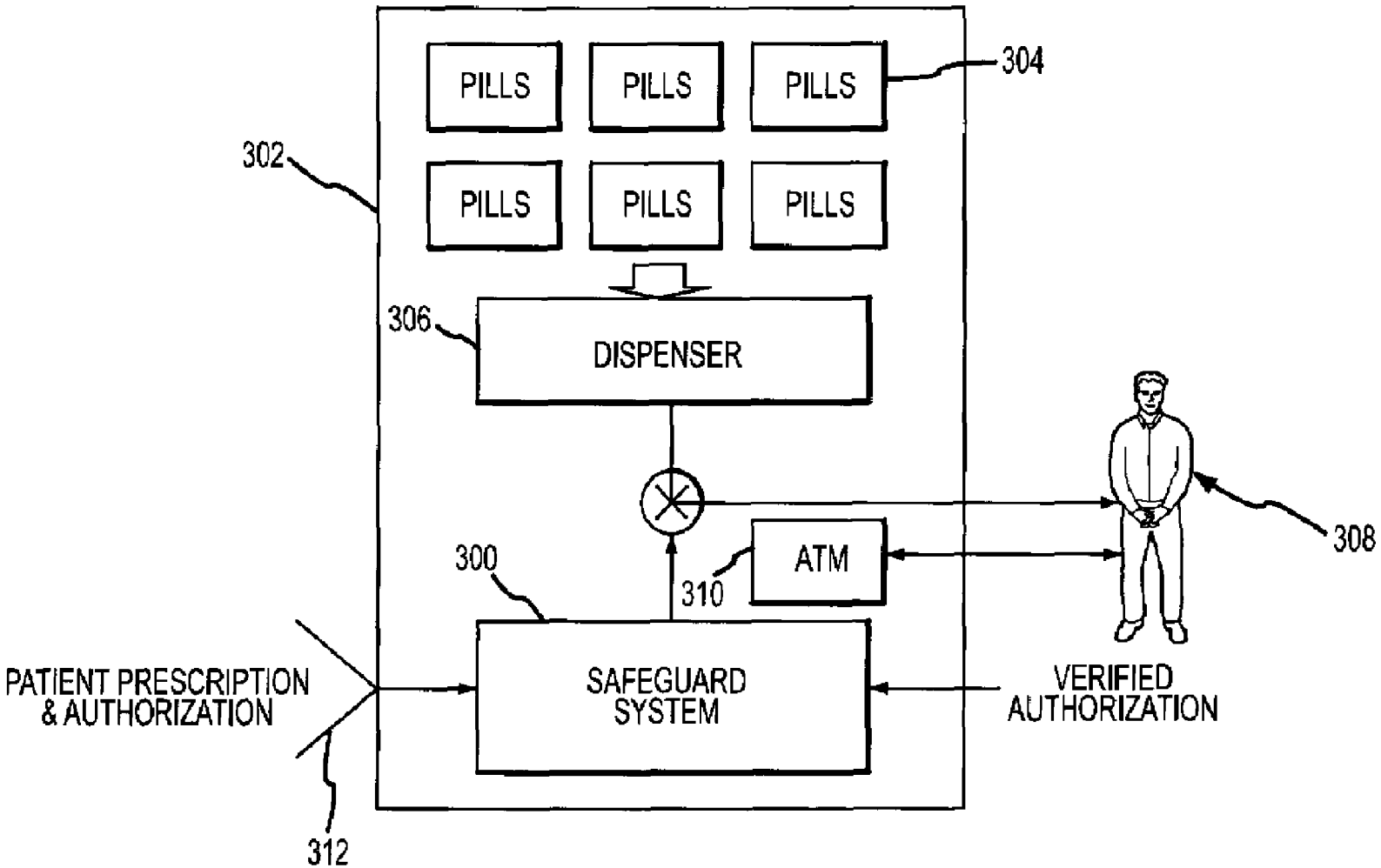
FIG. 12 is a diagram of an embodiment of the safeguard system for use with a vending machine for prescription drugs.

As shown in FIG. 12, a safeguard system 300 can be configured with a vending machine 302 to dispense prescription drugs and provide an 'automated pharmacist'. Such a prescription vending machine could be quite useful to fill prescriptions when pharmacies are closed, to alleviate long waits to fill prescriptions and to reduce costs. Of course, a prescription vending machine would only be viable if the possibility of misuse, error or tampering were very small. In this particular configuration, the vending machine includes a number of containers 304 containing different commonly prescribed pills in varying dosages. A dispenser 306 extract the pills from the appropriate container and verifies the pill, dosage and number before dispensing to the customer 308. The customer uses a debit or credit card to pay for the prescription using the ATM 310 in the machine.

The safeguard system 300 is configured as before to include any general or state laws that govern the dispensing of prescription drugs and the specific pills. The customer's doctor transmits the prescription and a patient authorization via the Internet, wireless or a wired network to a communication link 312 coupled to the safeguard system. The customer provides some form of authorization, e.g. a code or preferably a biometric, that is checked against the authorization on the prescription. The system could require the patient to bring the prescription and scan it in to double-check against the prescription sent by the doctor. If these match, the safeguard system checks the prescription against the rules to make sure the prescription conforms to the laws and possibly any medical guidelines for dispensing prescription drugs. If everything checks out, the customer pays for the prescription and the machine dispenses the pills. The safeguard system records the transaction.

While several illustrative embodiments of the invention have been shown and described, numerous variations and alternate embodiments will occur to those skilled in the art.

Such variations and alternate embodiments are contemplated, and can be made without departing from the spirit and scope of the invention as defined in the appended claims.

We claim:

1. A non-lethal directed energy weapons system, comprising:

a directed energy weapon adapted to transmit a directed energy beam to illuminate human targets; and a safeguard system that controls the weapon according to a legal protocol, said legal protocol defined by rules of engagement that embody the laws governing the use of the weapon, said safeguard system applying the rules of engagement to a requested use and a received authorization to use the weapon to determine whether the requested use is authorized and applying the rules of engagement to a sensed input condition relating to an attribute of the human target to determine whether the requested use of the weapon is legally justified to generate a control signal that fires the weapon in conformance with the legal protocol wherein said safeguard system includes an authorization system for authorizing an operator to use the weapon, said authorization including the operator's identifying information and a multi-valued authorization level that gives certain operators greater authorization to use the weapon than others, said authorization level authorizing zones of use and power levels of the weapon for the operator, said safeguard system determining whether the weapon is located in an authorized zone of use and whether the requested power level is legally justified.

2. The non-lethal directed energy weapons system of 1, wherein said received authorization is a multi-valued authorization that in part determines which rules apply.

3. The non-lethal directed energy weapons system of 1, wherein said received authorization includes a chain of at least two authorized personnel including the operator to use the device.

4. A non-lethal directed energy weapons system, comprising:

a directed energy weapon adapted to transmit a directed energy beam to illuminate human targets; and a safeguard system that controls the weapon according to a legal protocol, said legal protocol defined by rules of engagement that embody the laws governing the use of the weapon, said safeguard system applying the rules of engagement to a requested use and a received authorization to use the weapon to determine whether the requested use is authorized and applying the rules of engagement to a sensed input condition relating to an attribute of the human target to determine whether the requested use of the weapon is legally justified to generate a control signal that fires the weapon in conformance with the legal protocol, wherein said sensed input condition measures the IR signatures for a plurality of human targets of the directed energy beam, said safeguard system discriminating those targets that have and have not been exposed to the beam and directing the beam towards targets that have not been previously exposed.

5. A non-lethal directed energy weapons system, comprising:

a directed energy weapon adapted to transmit a directed energy beam to illuminate human targets; and a safeguard system that controls the weapon according to a legal protocol, said legal protocol defined by rules of engagement that embody the laws governing the use of the weapon, said safeguard system applying the rules of engagement to a requested use and a received authorization to use the weapon to determine whether the requested use is authorized and applying the rules of engagement to a sensed input condition relating to an attribute of the human target to determine whether the requested use of the weapon is legally justified to generate a control signal that fires the weapon in conformance with the legal protocol, wherein said sensed input conditions provide the location of targets within a zone of use and motion of targets towards or away from a protected area, said safeguard system directing the beam towards targets in the zone of use moving towards the protected area.

6. A non-lethal directed energy weapons system, comprising:

a directed energy weapon adapted to transmit a directed energy beam to illuminate human targets; and a safeguard system that controls the weapon according to a legal protocol, said legal protocol defined by rules of engagement that embody the laws governing the use of the weapon, wherein said rules require a sensed input condition related to the operational environment, said input condition being at least one of a location of the weapon, a zone of use for the weapon, a time of requested use, a movement of the device or a threat level, said safeguard system applying the rules of engagement to a requested use, a received authorization to use the weapon and a sensed input condition related to the operational environment to determine whether the requested use is authorized and applying the rules of engagement to a sensed input condition relating to an attribute of the human target to determine whether the requested use of the weapon is legally justified to generate a control signal that fires the weapon in conformance with the legal protocol.

7. A non-lethal directed energy weapons system, comprising:

a directed energy weapon adapted to transmit a directed energy beam to illuminate human targets; and a safeguard system that controls the weapon according to a legal protocol, said legal protocol defined by rules of engagement that embody the laws governing the use of the weapon, said safeguard system applying the rules of engagement to a requested use and a received authorization to use the weapon to determine whether the requested use is authorized and applying the rules of engagement to a sensed input condition relating to an attribute of the human target to determine whether the requested use of the weapon is legally justified to generate a control signal that fires the weapon in conformance with the legal protocol, wherein said rules specify a geographic zone of use and require sensed input conditions that provide the location of the weapon and its zone of use, said safeguard system determining whether the weapon's zone of use conforms to the specified geographic zone of use.

8. A non-lethal directed energy weapons system, comprising:

a directed energy weapon adapted to transmit a directed energy beam to illuminate human targets; and a safeguard system that controls the weapon according to a legal protocol, said legal protocol defined by rules of engagement that embody the laws governing the use of the weapon, said safeguard system applying the rules of engagement to a requested use and a received authorization to use the weapon to determine whether the requested use is authorized and applying the rules of engagement to a sensed input condition relating to an attribute of the human target to determine whether the requested use of the weapon is legally justified to generate a control signal that fires the weapon in conformance with the legal protocol, wherein said safeguard system issues the control signal to configure the directed energy weapon to emit a directed energy beam that conforms to the legal protocol.

9. A non-lethal directed energy weapons system, comprising:

a directed energy weapon adapted to transmit a directed energy beam to illuminate human targets; and a safeguard system that controls the weapon according to a legal protocol, said legal protocol defined by rules of engagement that embody the laws governing the use of the weapon, said safeguard system applying the rules of engagement to a requested use and a received authorization to use the weapon to determine whether the requested use is authorized and applying the rules of engagement to a sensed input condition relating to an attribute of the human target to determine whether the requested use of the weapon is legally justified to generate a control signal that fires the weapon in conformance with the legal protocol, wherein said safeguard system includes a documentation system that documents the requested use, authorization, sensed input condition, applied rules and control signal.

10. The non-lethal directed energy weapons system of claim 9, wherein the safeguard system receives a sensed input condition relating to an effect on the human target caused by exposure to the directed energy beam, said documentation system documenting said effect.

11. The non-lethal directed energy weapons system of claim 9, further comprising means for communicating the documentation to a remote location.

12. A non-lethal directed energy weapons system, comprising:

a directed energy weapon adapted to transmit a directed energy beam to illuminate human targets; and a safeguard system that controls the weapon according to a legal protocol, said legal protocol defined by rules of engagement that embody the laws governing the use of the weapon, said safeguard system applying the rules of engagement to a requested use and location of the weapon to determine whether the weapon is located in an authorized zone of use and applying the rules of engagement to a sensed input condition relating to an attribute of the human target to determine whether the requested use of the weapon is legally justified to generate a control signal that fires the weapon in conformance with the legal protocol.

13. A non-lethal directed energy weapons system, comprising:

a directed energy weapon adapted to transmit a directed energy beam to illuminate human targets; and a safeguard system that controls the weapon according to a legal protocol, said legal protocol defined by rules of engagement that embody the laws governing the use of the weapon, said safeguard system comprising an authorization system for authorizing an operator to use the weapon, said authorization including the operator's identifying information and a multi-valued authorization level that gives certain operators greater authorization to use the weapon than others, said authorization level authorizing zones of use and power levels of the weapon for the operator, said safeguard system applying the rules of engagement to a requested use and the operator authorization to determine whether the requested use of the weapon at location and power levels are authorized and applying the rules of engagement to a sensed input condition relating to an attribute of the human target to determine whether the requested use of the weapon is legally justified to generate a control signal that fires the weapon in conformance with the legal protocol.

14. A non-lethal directed energy weapons system, comprising:

a directed energy weapon adapted to transmit a directed energy beam to illuminate human targets; and a safeguard system that controls the weapon according to a legal protocol, said legal protocol defined by rules of engagement that embody the laws governing the use of the weapon, said safeguard system applying the rules of engagement to a sensed input condition relating to an attribute of the human target to determine whether a requested use of the weapon is legally justified to generate a control signal that fires the weapon in conformance with the legal protocol, said safeguard system comprising a documentation system that for each requested use documents the requested use, the sensed input condition relating to an attribute of the human target, the applied rules and control signal.

15. The non-lethal directed energy weapons system of 14, wherein the safeguard system applies the rules to the authorization and sensed condition for each requested use of the weapon.

16. The non-lethal directed energy weapons system of 14, wherein said sensed input condition being an attribute of the human target selected from at least one of a location, movement, persistence, identity, physical condition or an effect of the past use of the weapon on the human target.

17. The non-lethal directed energy weapons system of 14, wherein said sensed input condition measures an IR signature of the human targets of the directed energy beam.

18. The non-lethal directed energy weapons system of claim 14, wherein said rules require an identify friend or foe (IFF) to fire the weapon.

19. The non-lethal directed energy weapons system of claim 14, wherein said rules allow for the weapon to be fired at a limited energy for a limited number of shots prior to receiving authorization or the sensed input condition.

20. The non-lethal directed energy weapons system of claim 14, wherein said safeguard system generates the control signal that either enables the device for the requested use or disables the device.

21. The non-lethal directed energy weapons system of claim 20, wherein said requested use includes a desired effect on target.

22. The non-lethal directed energy weapons system of claim 14, further comprising rules for detecting tampering and for taking remedial action.

23. The non-lethal directed energy weapons system of claim 14, wherein the directed energy weapon and safeguard system are mounted on a vehicle.

24. A non-lethal directed energy weapons system, comprising:

a directed energy weapon adapted to transmit a directed energy beam to illuminate human targets; and a safeguard system that controls the weapon according to a legal protocol, said legal protocol defined by rules of engagement that embody the laws governing the use of the weapon, said safeguard system applying the rules of engagement to a requested use, a sensed location of the weapon and a received authorization to determine whether the requested use is authorized and whether the weapon is located in an authorized zone of use and applying the rules of engagement to a sensed input condition relating to an attribute of the human target to determine whether the requested use of the weapon is legally justified to generate a control signal that fires the weapon in conformance with the legal protocol, said safeguard system comprising a documentation system that for each requested use documents the requested use, the authorization, the sensed input condition relating to an attribute of the human target, the sensed location of the weapon, the applied rules and control signal.

* * * * *